US005415613A

United States Patent [19]

McGrath

[11] Patent Number: 5,415,613

[45] Date of Patent: May 16, 1995

[54] APPARATUS FOR MAKING A LOCKING JOIN FOR BOXES

[76] Inventor: Stephen E. McGrath, 64 Carl Crescent, Scarborough, Ontario L0G 1M0, Canada

[21] Appl. No.: 97,215

[22] Filed: Jul. 27, 1993

Related U.S. Application Data

[62] Division of Ser. No. 995,135, Dec. 22, 1992, abandoned.

[51] Int. Cl.[6] ..... B31B 3/60; B31B 17/68

[52] U.S. Cl. ..... 493/137; 493/390

[58] Field of Search ..... 493/137, 139, 350, 390

[56] References Cited

U.S. PATENT DOCUMENTS

| | | | |
|---|---|---|---|
| 2,864,287 | 12/1958 | Johnson et al. | 493/137 |
| 2,867,157 | 1/1959 | Moore | 493/137 |
| 3,953,634 | 4/1976 | Wooten | 493/390 |
| 4,062,270 | 12/1977 | Culpepper | 493/137 |
| 4,708,284 | 11/1987 | Sutherland et al. | 493/137 |
| 5,177,932 | 1/1993 | Schmetzer | 493/390 |

FOREIGN PATENT DOCUMENTS

| | | | |
|---|---|---|---|
| 2138352 | 10/1984 | United Kingdom | 493/137 |

*Primary Examiner*—William E. Terrell
*Attorney, Agent, or Firm*—Jane Parsons

[57] ABSTRACT

A non-releasable mechanical join useful for permanent joins of plastics material cartons is formed by a row of a plurality of engagement tabs interlocked in a complementary row of slots. The engagement tabs have heads able to passthrough the slots in one direction but unable to return in the other direction. The tab heads may be formed as arrowheads, the barbs of which act against edges of the slots to disallow withdrawal. Suitably, the leading edges of the slots ar convexly arcuate towards the approaching arrowheads. This may help to provide secure engagement. The greater the number oftabs and slots, the greater may be be the permanence of the join.

14 Claims, 8 Drawing Sheets

APPARATUS FOR MAKING A LOCKING JOIN FOR BOXES

RELATED APPLCIATIONS

This application is a divisional continuation application of U.S. Ser. No. 07/995,135, filed Dec. 22, 1992, abandoned.

BACKGROUND OF THE INVENTION

1. Field of the Invention

This invention relates to improvements in cartons made out of plastics material. More particularly the invention relates to locking joins between adjoining pieces of plastic material and to apparatus for forming these joins.

2. Acknowledgement of Prior Art

Cardboard boxes have traditionally been made from blanks which are folded to form the box. Usually, there is at least one join between the material from which the box is formed on a side wall, possibly near a corner. The bottom of such a box is frequently made from in-turned flaps which are interlocked or sealed together. For cardboard cartons, gluing has been a traditional and satisfactory way of forming the necessary seals.

As environmental concerns have become of more importance and recycling of cardboard materials has been found to be desirable, the presence of glue has become a disadvantage.

The environmental concerns have caused consideration of the use of plastics material cartons. Such cartons, if satisfactory, may be capable of a considerable amount of reuse before recycling is necessary. When recycling becomes necessary, the recovered plastics material is potentially more useful than the recovered recycled material from paper recycling. Theoretically at least, it is possible to recycle plastics material in very pure form, and it may be used for primary uses of the plastic. It is, however, necessary that the plastics material to be recycled must be very pure, i.e. free of contaminants such as glue, metal fasteners, adhesive tape, etc. A certain amount of printing ink is acceptable, but even this will affect the colour of the recycled plastic material.

The use of glue, metal fasteners, adhesive tape or other sealing means for making seals between pieces of plastics material may be undesirable for other reasons. There may be a tendency for metal fasteners to tear out of the plastics material, and it is of course necessary to provide a manufacturing step for inserting them into position. Glues have to be carefully chosen to be suitable for forming permanent seals. Adhesive tapes may be unsightly and uneconomic.

The method of making permanent seals between pieces of plastics materials which has been widely used is that of welding the two pieces of plastic together, either by heat sealing or by ultrasonic welding. This manner of sealing may be satisfactory if accurately carried out over large enough contact areas. Nevertheless, a problem has existed in forming a permanent join between two pieces of plastics material; and the need for simple mechanical means which may be automated for providing such a joint is considerable.

The present applicant has several earlier patent applications directed to cartons made of plastics material. His U.S. patent application nos. 802,292 filed 4th Dec. 1991 and 802,293 also filed 4th Dec. 1991 are directed to openable and closeable seals, which may be used for releasably engaging either or both of the top or bottom flaps of cartons such as beer cartons. Those releasable seals have considerable strength and a variety of advantages.

The present applicant has now directed his attention to the problem of providing a truly permanent seal by simple mechanical means without the need of contaminants for the plastic or without the need for welding.

SUMMARY OF THE INVENTION

According to the invention, there is provided in a carton formed of resilient plastics material, a mechanical joint between first and second plastics material panels, e.g. side walls of the carton, the first panel having a first edge and a first margin bordering said first edge, a plurality of aligned, spaced apart slots being provided in the margin parallel to the first free edge; the second panel having a second edge and having a similar plurality of tabs projecting from the second edge; the tabs having tab heads non-returnably insertable fully through the slots in one direction; the tab head being inserted through respective slots.

The tabs may be formed such that each tab has a neck portion and a tab head, each tab head has a leading insertion tip having a width less than the length of a respective slot; each tab head has a trailing non-return edge having a length greater than the length of the respective slot. The tabs are engaged in the slots to form the joint with the neck portion extending through the slots so that the tab heads are to one side of the first margin and the second edge is to the other side of the first margin. The tab heads are suitably shaped as arrowheads.

Preferably each slot has an arcuate edge nearer the first edge of the first panel and an edge further from the first edge of the first panel. The arcuate edge suitably is convex towards the first edge of the first panel.

The invention also comprises apparatus for forming a mechanical join between first and second plastics material panels at 90 degrees one to the other, the first panel having a first edge and a first margin bordering said first edge, a plurality of aligned, spaced apart slots being provided in the margin parallel to the first free edge; the second panel having a second edge and having a similar plurality of tabs projecting from the second edge; each tab having a neck portion and a tab head, each tab head having a leading insertion tip having a width less than the length of a respective slot, each tab head having a trailing non-return edge having a length greater than the length of the respective slot.

The apparatus may comprise means to locate the first margin in a pre-chosen position; means to hold the first margin in said pre-chosen position; means to locate the second panel at 90 degrees to the first panel; means to make a bend between the second margin and the second panel whereby the second margin is bent at generally 90 degrees towards the first margin; means to locate the second panel and the second margin into a position such that the insertion tips of the tabs of the second margin are at generally 90 degrees to the first margin to overlie a first edge of a respective slot and fall short of a second edge of the respective slot; means to depress the insertion tips and the respective first edges of the respective slots; and means to advance the insertion tips and the non-return edges through slots.

BRIEF DESCRIPTION OF THE DRAWINGS

Embodiments of the invention will now be described by way of example with reference to drawings in which.

DETAILED DESCRIPTION OF PREFERRED EMBODIMENTS

FIGS. 1, 2, 3, 4, 5 and 6 illustrate an embodiment of a locking join according to the present invention formed between varying pieces of plastic in different configurations. Such a join may be assembled manually or by using the apparatus illustrated in FIGS. 5, 6, 7 and 8. Other suitable apparatus for forming the join may also be possible.

Figure 1:
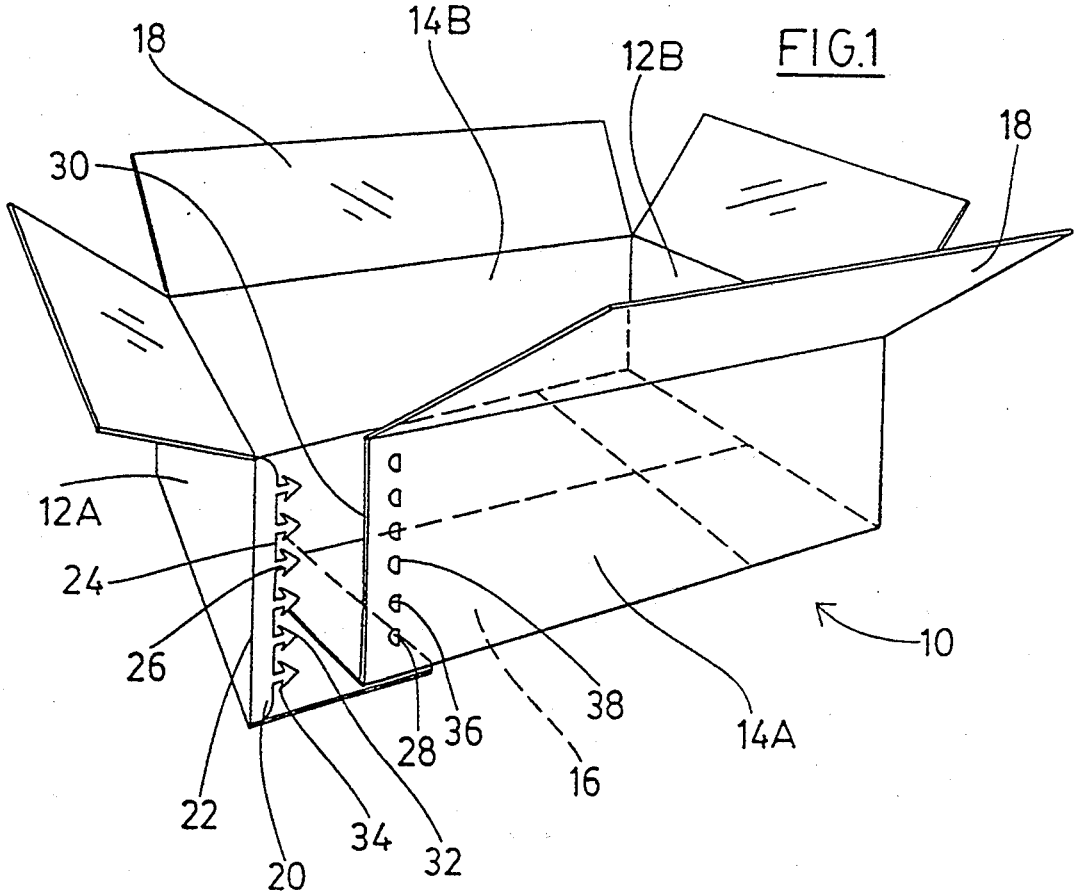
FIG. 1 shows a partially folded, unsealed carton, having means to make a locked join according to the present invention.
Figure 2:
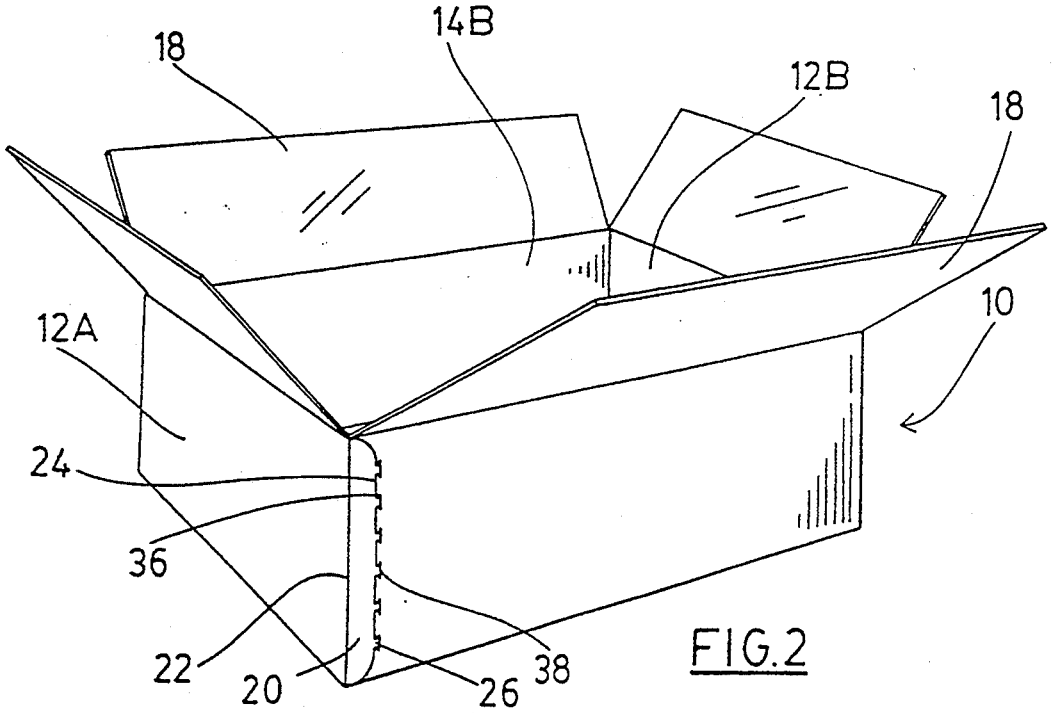
FIG. 2 shows the carton of FIG. 1 with the locked permanent join in place.

FIG. 1 shows a partially folded carton blank 10. From the folding of the blank it may be seen that the carton blank 10 is intended to form a carton having end walls 12, side walls 14 and that bottom flaps 16 fold up to form the bottom and top flaps 18 fold down to form the top. In order to form the carton blank into a carton it is necessary to connect end wall 12*a* with side wall 14*a*. This connection should be made in a permanent manner and should be sufficiently strong to withstand several re-uses of the carton before recycling.

For this purpose, side wall 14*a* is provided with a lip 20 extending over the height of the side wall 14*a* and joined to it through a coined fold line 22. At spaced intervals along the free edge 24 of the lip 22 are provided a number of tabs 26.

The end wall 12*a* is provided with a number of slots 28 in the margin of its free edge 30. The slots 28 are arranged generally vertically, and their number and location are such as to correspond with the number and location of tabs 26 in forming a join between the tabs 26 and the slots 28.

The tabs 26 are provided with shaped heads 32. The heads are shaped so as to allow passage of the head through a corresponding slot in one direction, but to impede passage of the head through the slot in the other direction. Thus, as illustrated in FIG. 1, 3, 4, and 5, the tab heads are formed as arrowheads with the points directed for insertion into corresponding slots 28. It is possible to insert the points of the arrowheads 32 into the corresponding slots 26 and thereafter push the entire head through the slot. Passage of the head in the reverse direction will be impeded by the barbs 34 of each arrowhead 32 in its respective slot 28. It will be appreciated, that the length of the slots must not be so great as to allow removal of the arrowheads. While such a locking join has some utility of only an arrowhead and slot constitute the join, it might be possible to deform or force a single arrowhead out of its slot. The use of several, e.g. 10 or more arrowheads and slots makes it much less easy to adjust the position of the arrowheads in the slot to allow for their protected withdrawal.

It will also be appreciated that, while arrowheads are illustrated as the directional tab heads 32, any other form of enlarged head is possible. Thus, the tab heads might be of semi-circular form having a leading circular edge. In this case the circular edge might be inserted in the slot and the remainder of the tab head forced through behind it. The diameter of the circle would then act as a stop to prevent return of the head through the slot. Other shapes of tab head are clearly possible.

The slots 28 may be simple line slits, but, for ease of entry of the leading point of the respective arrowhead 32, it is convenient that the slots 28 have some width. It is especially convenient that the slot 28 be of semi-circular form or have the form of a minor chordal section of a circle. The arcuate edge 36 of such a slot may be presented first to the leading point of arrowhead 32. As the leading point of arrowhead 32 overlaps the arcuate slot edge 36 the arrowhead 32 may be depressed slightly to insert the leading point beneath straight edge 38 of the respective slot 28.

Figure 5:
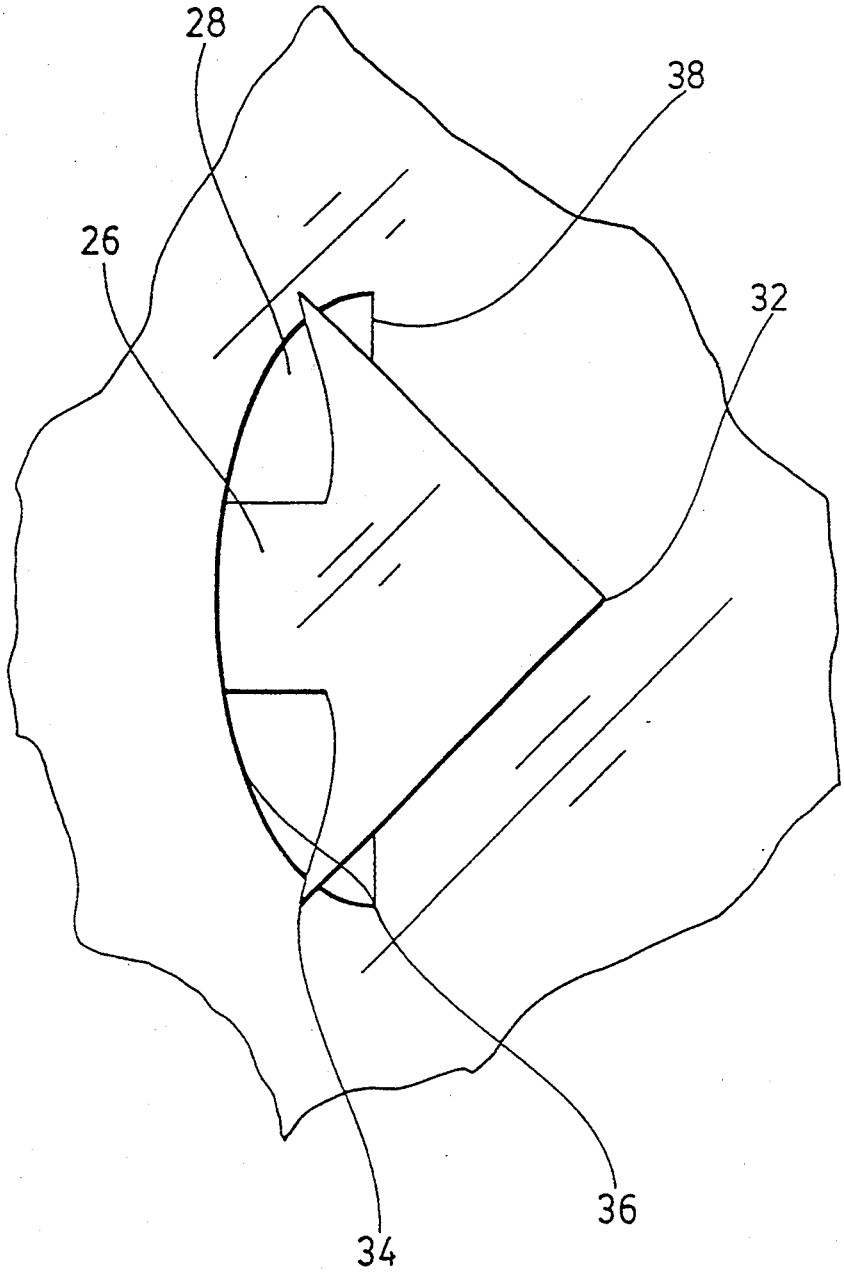
FIG. 5 shows a more detailed illustration of a join according to the invention.
Figure 6:
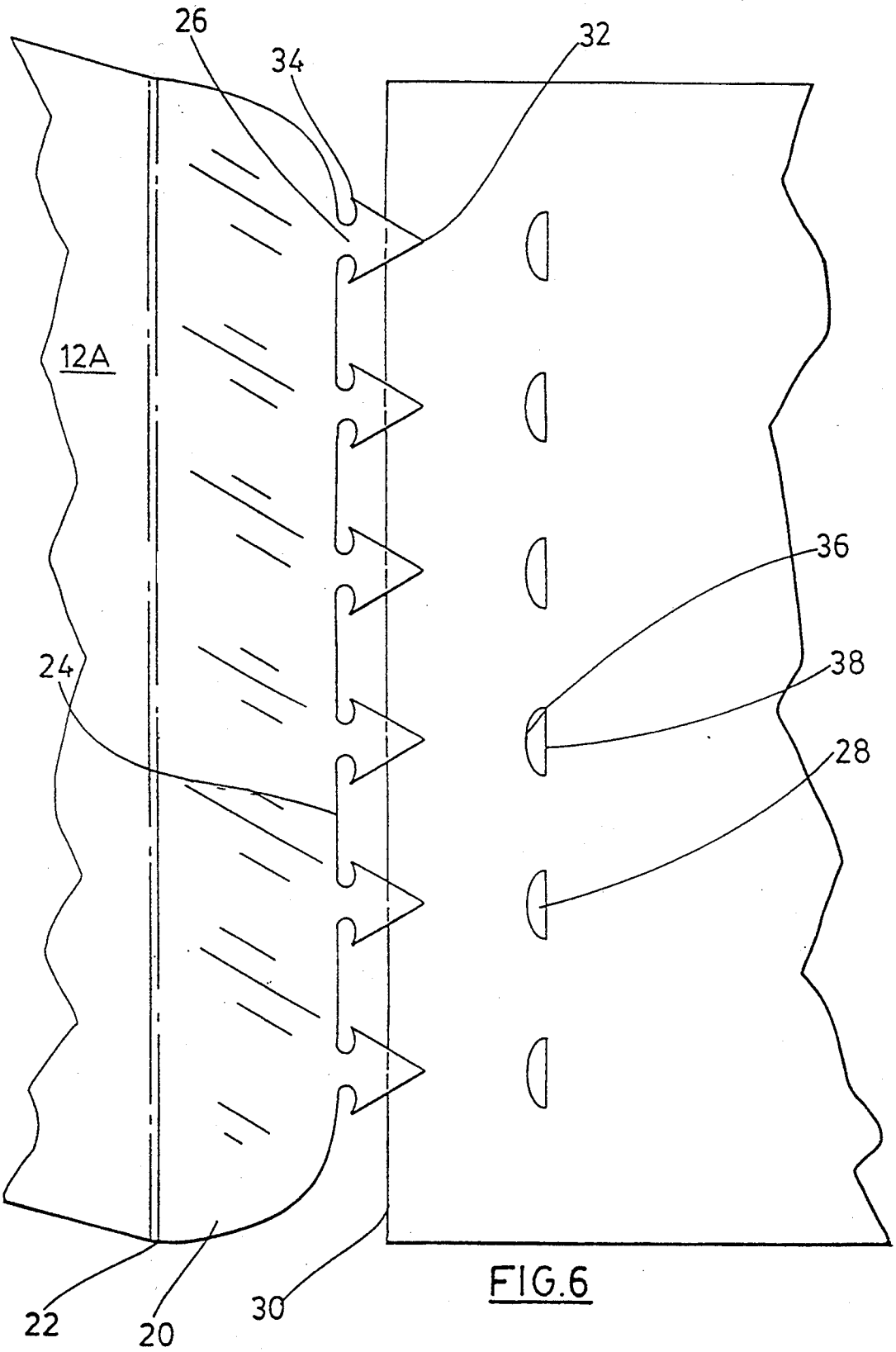
FIG. 6 shows a greatly enlarged view of part of the join of FIG. 5 showing a locking mechanism.

A slot having an arcuate edge may have a further advantage as may be seen from FIG. 6. After insertion of the arrowhead 32 into the slot 28, any stress on the resulting join in an opening direction will pull the barbs to interlock with the arcuate edge as shown in FIG. 5.

When the plastics material is wholly undeformed the distance between the barbs 34 of each arrowhead 32 may be greater than the length of each respective slot 28, but when the slot 28 has an arcuate edge 36 the slot length and barb width may be equal or the barb width may be slightly narrower than the slot. When the barb width is greater than the slot length, the plastics material will be slightly deformed to allow passage of the barbs through the slots during insertion. Once the barbs 34 have passed through the slots pressure on them will be relieved and they will return to their undeformed state. Any attempt to pull the joint apart will latch the barbs against the plastics material to each end of the respective slot 28.

Depending upon the flexibility of the plastics material chosen, the distance between the barbs can be appreciably greater than the length of the respective slot and barb width may be equal or the barb width may be slightly narrower than the slot. When the barb width is greater than the slot length. Nevertheless, a preferred barb width may be such as to allow 15/1000 to 50/1000 inch overlap at each end of the slot. More preferred is an overlap in the region of 20/1000 inch.

Figure 3:
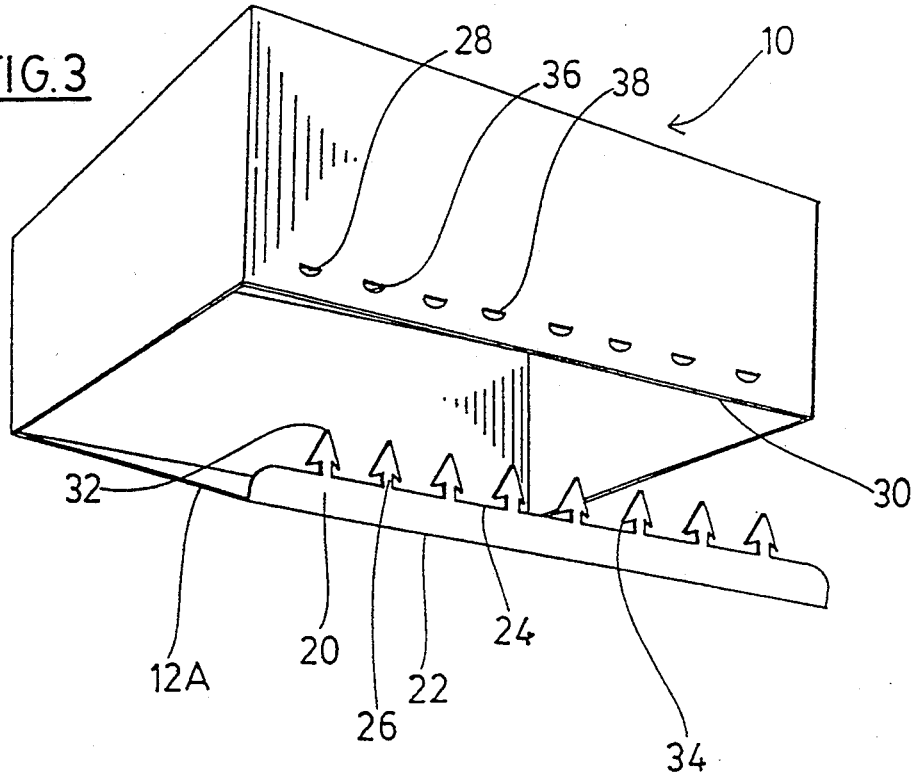
FIG. 3 shows another unassembled join according to the invention between different plastics material surfaces.
Figure 4:
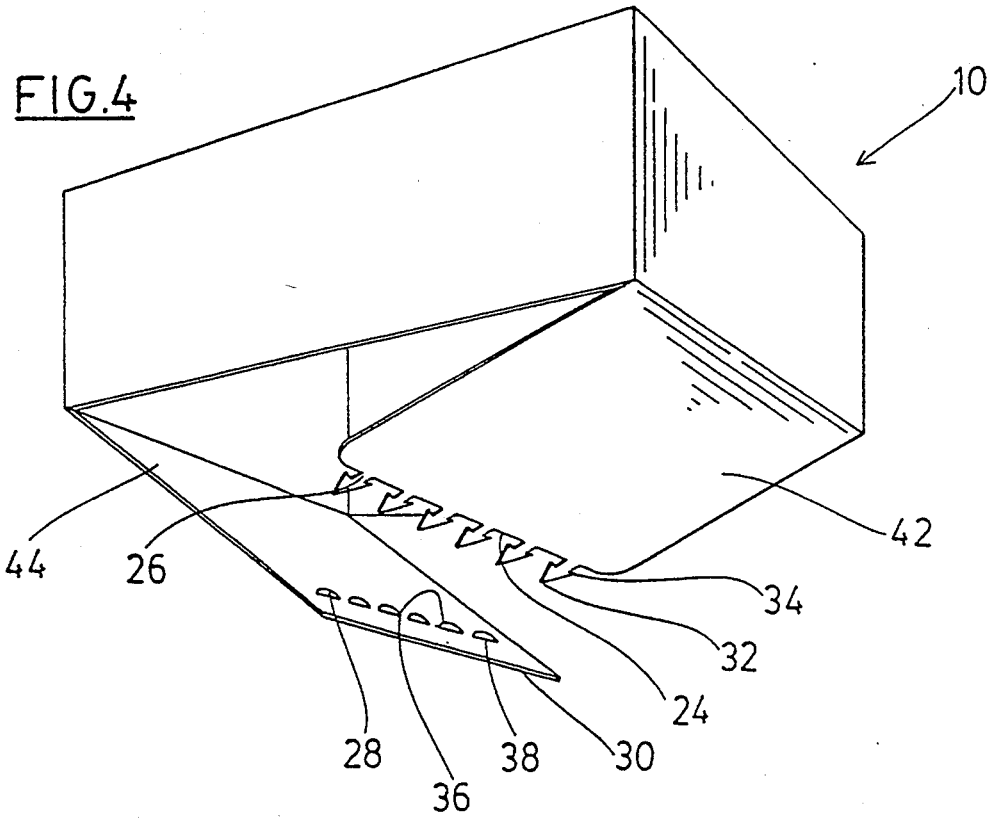
FIG. 4 shows yet another unassembled join according to the invention between further plastics material surfaces.

It may be quite easy to manually form a joint of appreciable length by carefully inserting the tip of each arrowhead into its respective slot as a preliminary step and thereafter forcing all the arrowheads through the slots by pressure over the height of side wall 14*a* in the region of the joint while holding end wall 12*a* firmly in position. Once the joint is formed it may be no more obtrusive than a glued or welded joint, as may be seen from FIG. 2. FIG. 3 indicates a similar join to that of FIGS. 1 and 2, but it is shown on a bottom surface of a carton in which a single bottom flap 40 is provided. For some purposes locking joins are also required in lid panels and the FIG. 3 arrangement may be used for such lids. It will, however, be necessary to damage the box to release such a lid. FIG. 4 shows another box having a join similar to that of FIG. 1. In this case the joint is formed between two opposing bottom flaps 42. A second inner pair of bottom flaps 44 may be provided for extra physical strength of the bottom.

Figure 7:
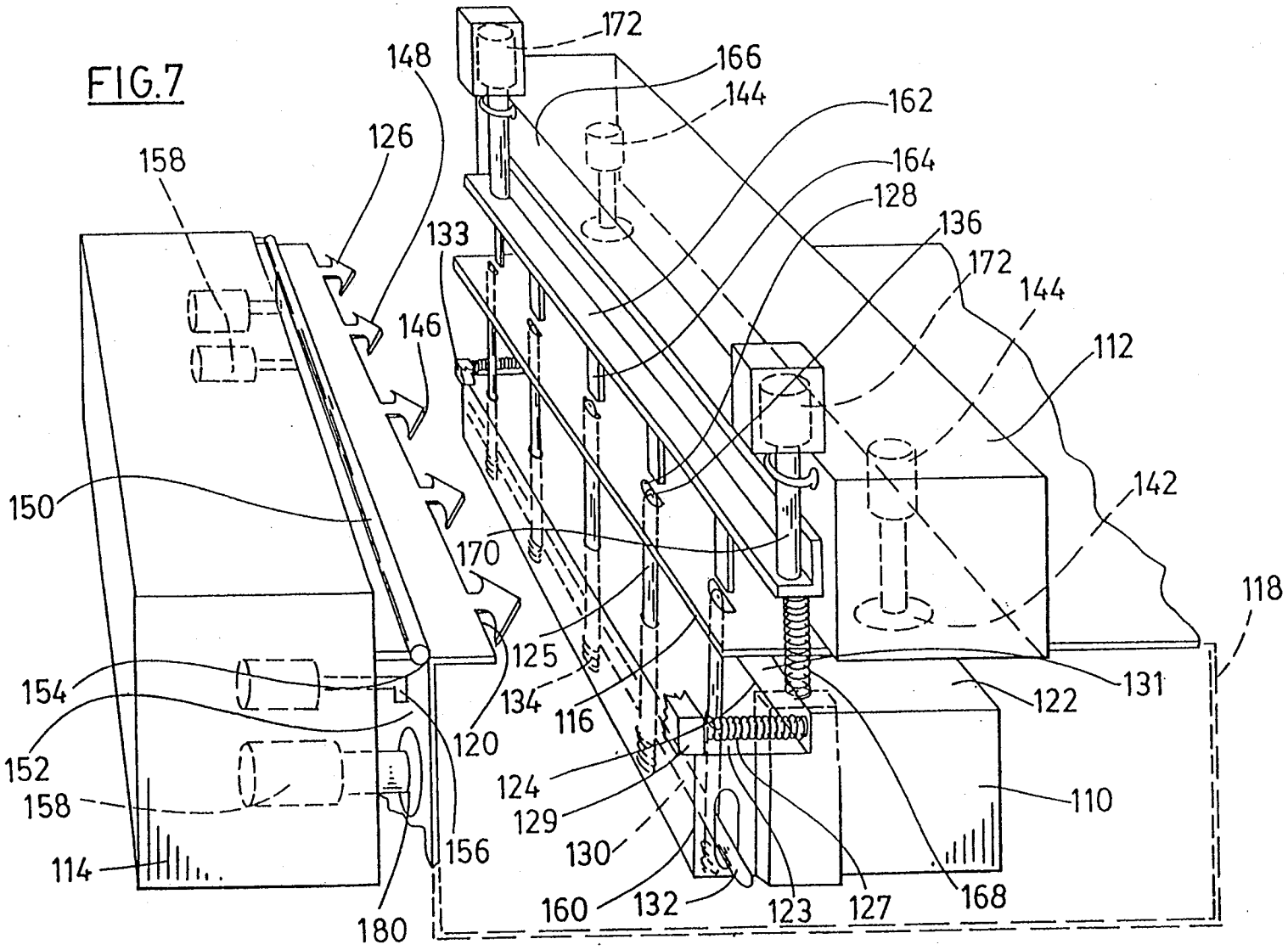
FIG. 7 illustrates apparatus according to the invention for making a join.
Figure 8:
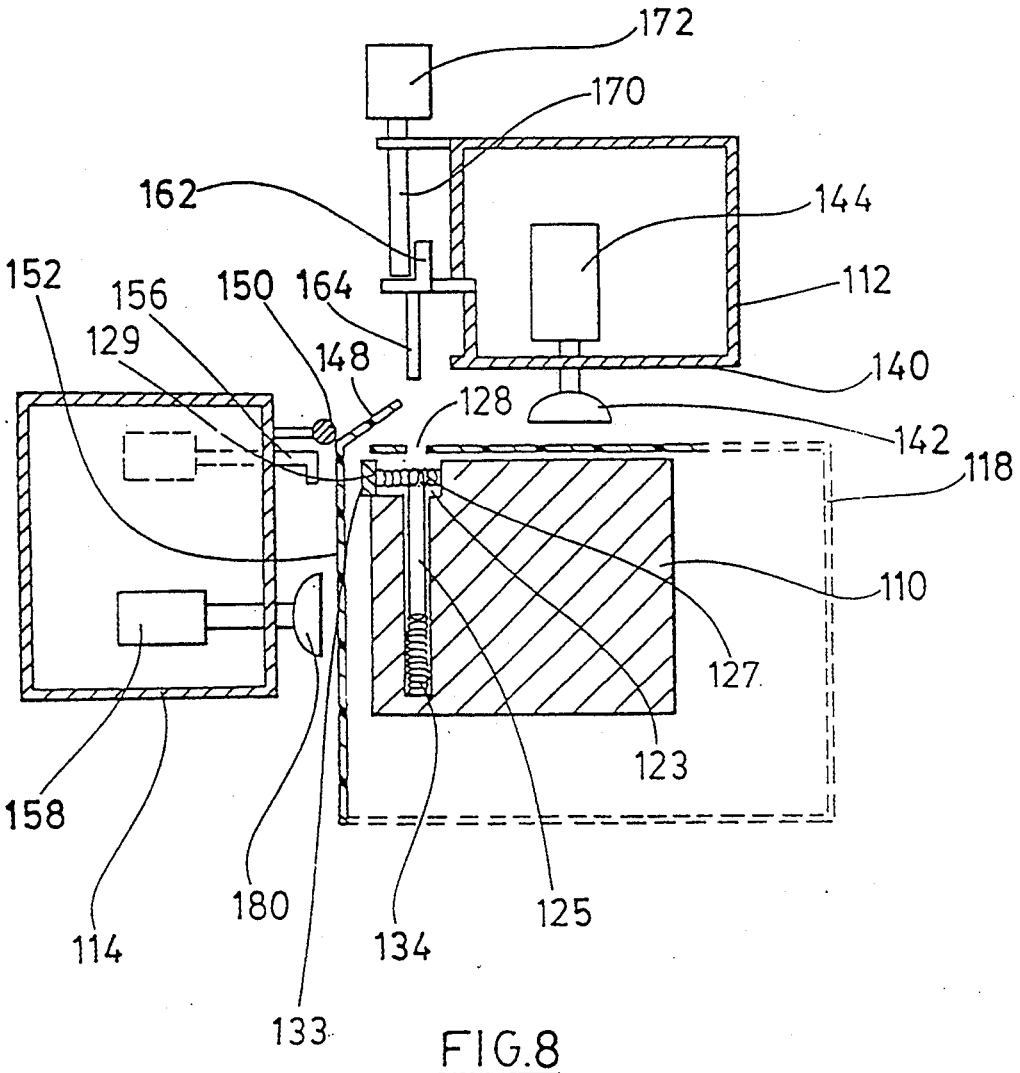
FIG. 8 is a section of FIG. 6 on the line VII—VII.

Although, as has been described, the joins according to the invention may be formed manually, it may be considerably more convenient and faster to form them using apparatus designed for this purpose. Such apparatus is illustrated in FIGS. 7, 8 and 9.

An embodiment of apparatus according to the invention comprises assembly blocks 110, 112 and 114.

Assembly block 110 is a locating block for one margin 116 of a carton blank 118 in a position for forming a locking join according to the invention with another margin 120 of the carton blank 118. Locating block 110 comprises a flat surface 122 onto which the margin 116 of the carton blank 118 is placed. The flat surface 122 has recess 124 along a forward edge, over which recess 124 margin 116 extends. Recess 124 is provided with a movable wall 125 by means of a bar 129 which is biassed by a spring 127 to project outwardly of a vertical wall 160 of locating block 110.

Margin 116 is provided with slots 128 similar to slots 28 described herein above with respect to exemplary embodiments of the inventive locking joints. Thus, slots 128 have leading arcuate slot edges 136 and trailing straight edges 138.

The margin 116 of the carton blank 118 may be located in the position thus far described either by automatic means or manually. However, in order to form a mechanical locking joint according to the invention, it is necessary to locate and hold the margin 116 precisely in position. For this purpose, locating block 110 is provided with locating pins 126. These locating pins 126 are carried on a bar 130 located beneath the recess 124 and in a vertical plane with it. In fact, as shown in FIG. 7, bar 130 is located within locating block 110 and is reciprocally moveable upwardly and downwardly in any convenient guide means. The guide means may, at least partially, comprise the groove 123 between the movable bar 129 and the inner wall of the recess 124.

For manual operation the bar 130 may extend out of locating block 110 at its ends 132, each end 132 forming a handle by which the bar may be raised or lowered. When the bar 130 is raised, locating pins 126 extend upwardly out of groove 123 into slots 128 to position the margin 116 of the carton blank 118 precisely. The number of locating pins 126 is, of course, complementary to the number of slots 128. The bar 130 may be provided with means for interchanging the locating pins so that the apparatus may be used with carton blanks of different sizes having slots 128 having different spacings therebetween.

Conveniently, the bar 130 is spring-biassed upwardly by springs 134 so that the locating pins 126 normally extend above the flat surface 122 of locating block 110. Thus it is relatively easy for a manual operator to locate margin 116 immediately in position so that the slots 128 are engaged by the locating pins 126.

Once the margin 116 is in this position it may be retained firmly in this position by clamping block 112 acting against the top surface of the locating block 110.

Clamping block 112 is located immediately above and parallel to locating block 110. Projecting from an undersurface 140 are clamps for holding the carton blank 118 firmly in position. When locating pins 126 have located margin 116 in its proper position, clamps 142 may be activated to press against the carton blank 118 to hold it in position against locating block 110. Suitably, the clamps 142 may comprise suction feet which will not damage the carton blank 118 unless unreasonably great pressure is exerted.

Clamps 142 may suitably be activated by solenoids 144 which are conveniently situated within the clamping block 112. It will of course be appreciated that many other methods of activating the clamps 142 may be provided. Indeed, the suction cups of clamps 142 are merely described by way of example, since any number of pressing means may be used to hold the carton blank 118 in position.

Clamping block 112 also carries insertion means for inserting the tabs 126 into the slots 128. The operation of these will be described hereinbelow. It is to be noted that tabs 126 may be similar to the tabs 26 described herein above with respect to the exemplary inventive locking joints of the invention.

Once margin 116 is located on the insertion pins and is firmly held in position by clamps 142 the insertion pins may be withdrawn into their lower position, in which they do not protrude through slots 128. Thus, bar 130 is depressed against bias of springs 134, for example, manually by handles 132. Means may be provided for retaining the bar in its lower position.

The carton blank 118 is arranged so that its second margin carrying tabs 126 is in the position shown in FIG. 7. Thus, carton blank 118 extends around locating block 110 so that margin 120 approaches margin 116 with which it is to be engaged. Engagement block 114 is located parallel with locating block 110 and generally in the same horizontal plane with margin 120 extending vertically upwardly between the blocks 110 and 114.

Engagement block 114 operates first to engage the tips 146 of tab heads 148 of margin 120 into or immediately over slots 128 of the other margin 116, and, second, after operation of the insertion of the clamping block 112, to fully insert the tab heads 148 in the slots 128.

Tab heads 148 may conveniently be arrowheads as previously described having leading tips 146 of the arrowheads 148. Engagement block 114 comprises a reciprocally moveable clamp 180 which is extensible to press panel 152 against bar 129 (see FIG. 8*b*). Bar 129, at this point, projects from wall 160 under bias of springs 127. The distance it projects is chosen such that the tips 146 overlie the arcuate edges 136 of slots 128 but fall short of straight edge 138 in a horizontal plane to push the margin 120 in the direction of locating block 110. Above clamp 180, of hinging bar 150 projects beyond it towards the locating block 110 to bend margin 120 downwardly. Conveniently a coined line 154 may be provided between margin 120 and panel 152.

As the hinging bar 150 bends the margin 120, clamps 180 extend horizontally from engagement block 114 towards locating bar 129 to clamp panel 152 thereagainst. The clamps 180 may be similar in structure to clamps 140. Thus, they may be actuated by solenoids 158 located within engagement block 114. It will, of course, be appreciated that clamps of any suitable form may be utilized.

Clamping block 112 carries moveable bar 162 which, in turn, carries insertion pins 164. The moveable bar 162 is located parallel with clamping block 112 slightly spaced from a front vertical wall 166. Conveniently the moveable bar 162 is an L section which may run in guides (not shown) to reciprocate in a vertical direction upwardly and downwardly. The insertion pins 164 are the same in number as the slots 128 and are spaced apart in a similar manner. Conveniently, provision is made on the moveable bar 162 alter the spacing of the insertion pins so that the apparatus may be used with cartons having different locking joints.

The moveable bar 162 may be biassed upwardly by springs 168 so that the insertion pins 164 are normally withdrawn from the slots 128.

When the tips 146 of arrowheads 148 are located over the slots 128 short of the trailing edges 138 of the slots, the next step is to insert the arrowheads fully into the slots. This may be accomplished by moving moveable bar 162 downwardly a sufficient distance for the distal ends of the insertion pins 164 to press against the tips 146 of the arrowheads of 148 to depress them below the level of the trailing edges 138 of the slots 128. Movement of the bar 162 may be accomplished by plungers 170 of solenoids 172 as illustrated. However, it will be appreciated that manual operation of the bar is also possible.

It is quite possible that locating pins 125 are individually spring mounted in guides of locating block 110 rather than mounted on a bar as shown. In the case of individually spring mounted locating pins, the insertion pins 164 may depress the tips 146 of arrowheads 148 into the slots 128 against the locating pins which are still spring biassed upwardly.

In any event, once the tips 146 of the arrowheads 148 are depressed below the trailing edges 138 of the slots 128, the arrowheads 148 may then be fully inserted through slots 128. Further clamps 156 capable of overcoming the spring bias of springs 127, may be extended to push the arrowheads 148 fully home into slots 128. As described for the locking joints of the boxes of FIGS. 1–6 the barbs of the arrowheads 148, which may be spaced more widely apart than the ends of the slots 128 will lock into the slots 128 so that they may not be withdrawn.

Figure 9A:
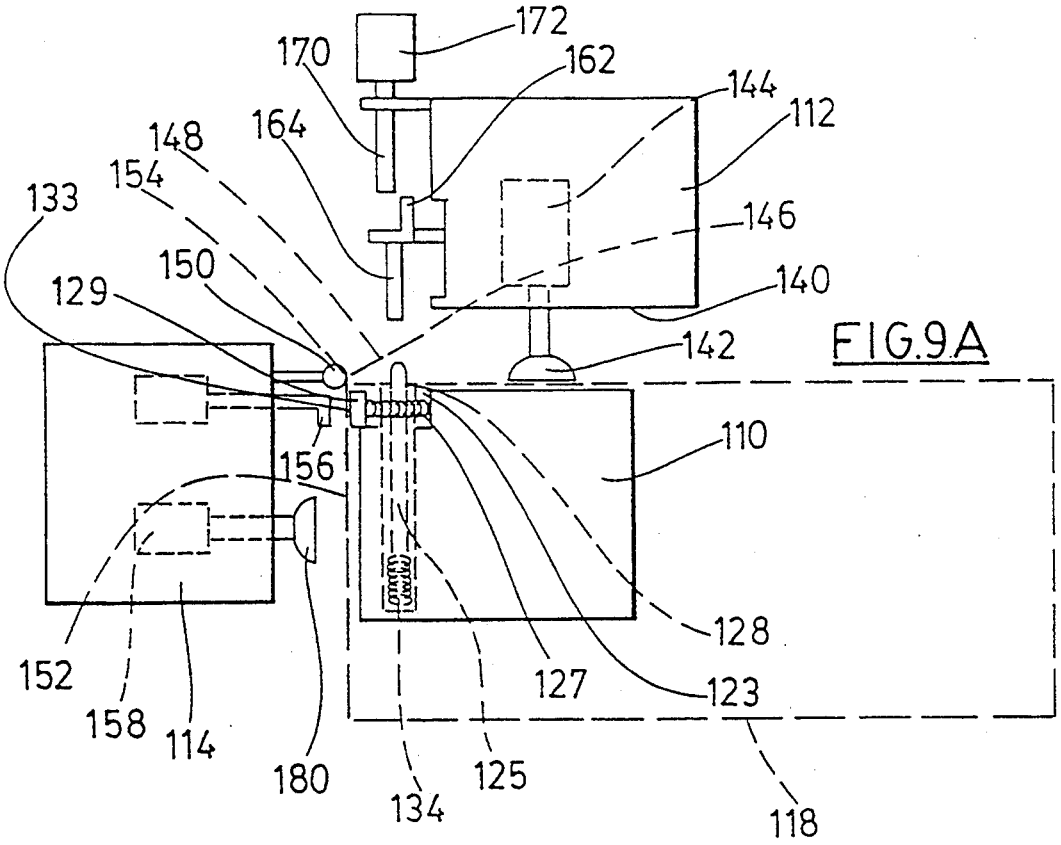
FIGS. 9*a*, 9*b* and 9*c* are simplified sections similar to that of FIG. 7, showing the steps of operation in forming the joint.
Figure 9B:
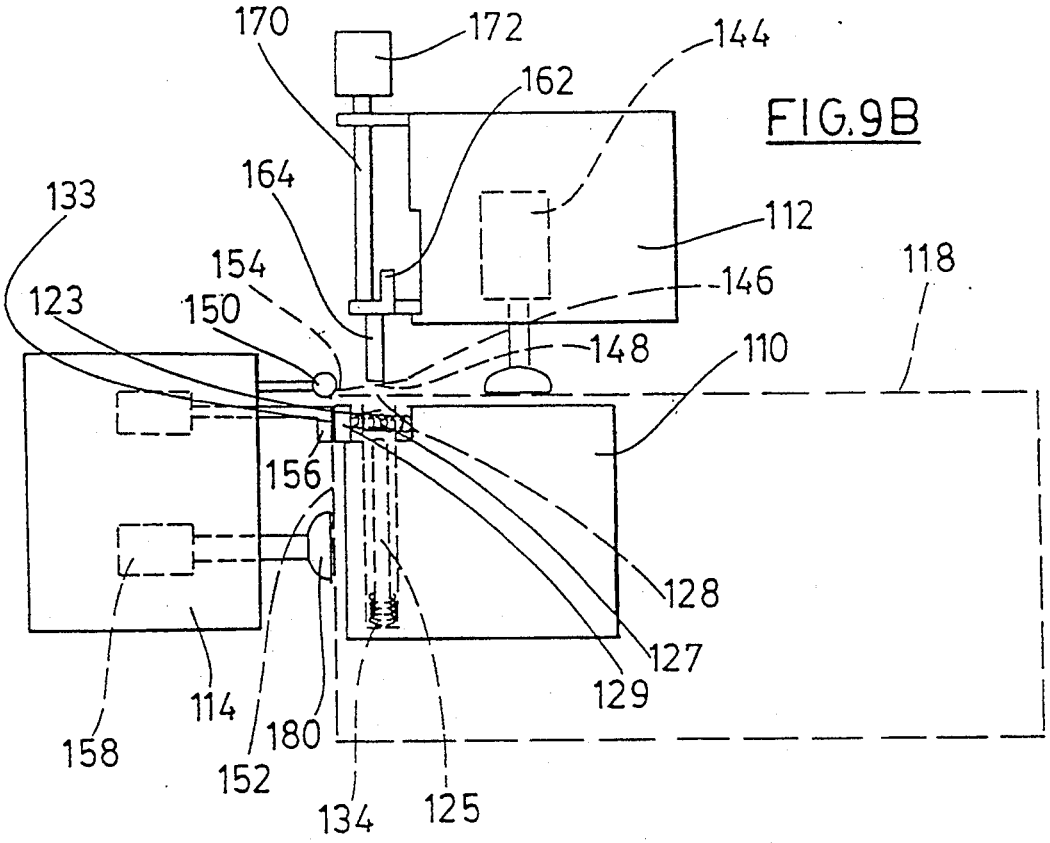
Figure 9C:
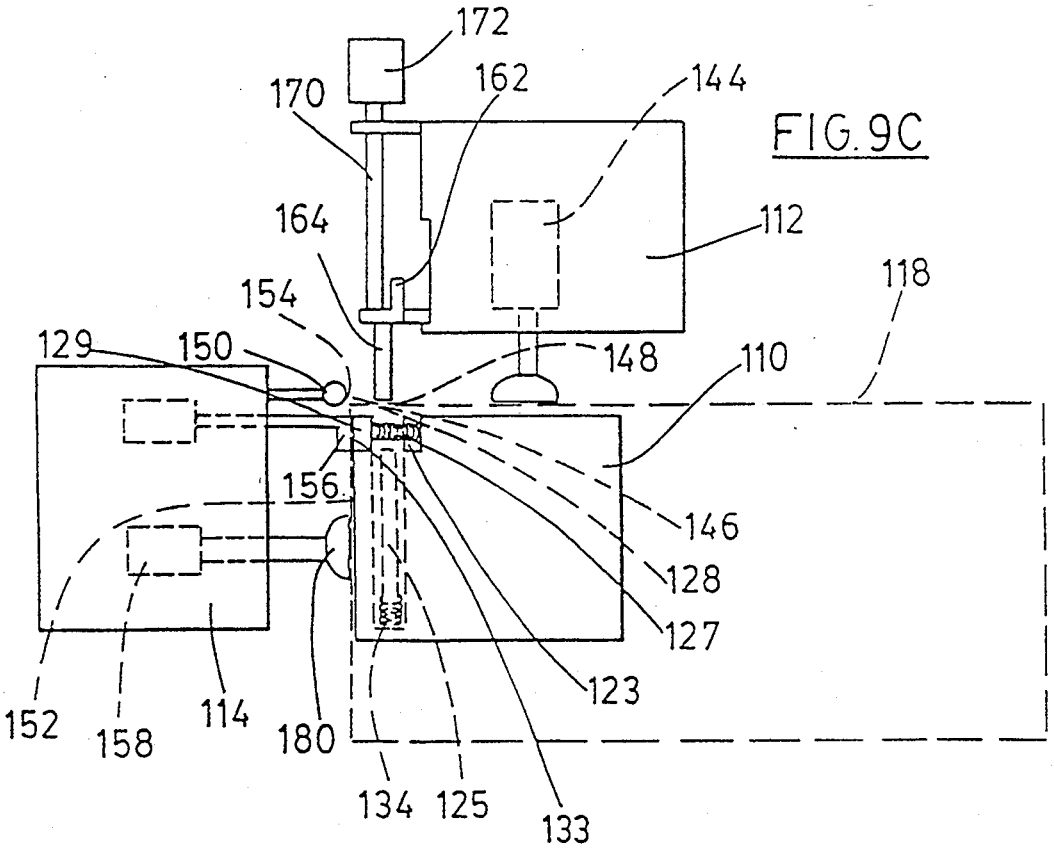

FIGS. 9*a*, 9*b* and 9*c* show simplified sections somewhat similar to that of FIG. 7 showing various chosen stages of operation of forming a locking joint according to the invention using the illustrated apparatus.

I claim:

1. Apparatus for forming a mechanical join between first and second plastics material panels at 90 degrees one to the other, the first panel having a first edge and a first margin bordering said first edge, a plurality of aligned, spaced apart slots being provided in the margin parallel to the first free edge;

the second panel having an second edge and having a similar plurality of tabs projecting from the second edge;

each tab having a neck portion and a tab head, each tab head having a leading insertion tip having a width less than the length of a respective slot, each tab head having a trailing non-return edge having a length greater than the length of the respective slot;

the apparatus comprising;

means to locate the first margin in a pre-chosen position;

means to hold the first margin in said pre-chosen position;

means to locate the second panel at 90 degrees to the first panel;

means to make a bend between the second margin and the second panel whereby the second margin is bent at generally 90 degrees towards the first margin;

means to locate the second panel and the second margin into a position such that the insertion tips of the tabs of the second margin at generally 90 degrees to the first margin overlie a first edge of a respective slot and fall short of a second edge of the respective slot;

means to depress the insertion tips and the respective first edges of the respective slots; and means to advance the insertion tips and the non-return edges through the slots.

2. Apparatus as claimed in claim 1 in which the first edge of each slot is arcuate.

3. Apparatus as claimed in claim 1 in which the second edge of each slot is straight.

4. Apparatus as claimed in claim 2 in which the arcuate edge is convex towards the first edge of the first panel.

5. Apparatus as claimed in claim 1 in which the means to locate the first margin comprises spring biassed locating pins, reciprocally movable into a locating position in which the locating pins engage the slots, and a retracted position.

6. Apparatus as claimed in claim 1 in which the means to hold the first margin comprises a clamping surface and at least one clamping member movable between a clamping position in which it presses the first margin against the clamping surface and a withdrawn position.

7. Apparatus as claimed in claim 6 in which the clamping members are solenoid activated.

8. Apparatus as claimed in claim 1 in which the means to locate the second panel at 90 degrees to the first panel comprises a guideway located at 90 degrees to the pre-chosen position and sized to accommodate the full width of the second panel.

9. Apparatus as claimed in claim 8 in which the guideway is provided between a locating block of generally rectangular cross section defining the pre-chosen position of the first margin by a flat, upper surface and having a vertical surface defining one side of the guideway.

10. Apparatus as claimed in claim 8 in which a vertical wall of a second rectangular block defines a further wall of the guideway.

11. Apparatus as claimed in claim 10 in which the means to locate the second panel and the second margin into a position such that the insertion tips of the tabs of the second margin at generally 90 degrees to the first margin to overlie a first edge of a respective slot and fall short of a second edge of a respective slot comprise a bar carried on the second rectangular block and parallel to it, the bar being carried by arms which are extensible from the second rectangular block towards the first rectangular block across the guideway generally at a level of the flat surface of the first rectangular block, the hinging bar acting to fold the second margin generally at 90 degrees to the second panel.

12. Apparatus as claimed in claim 11 in which clamping members extend from the vertical wall of the second rectangular block towards the vertical wall of the first rectangular block, the clamping members being extensible to press the second panel against the vertical wall of the first rectangular block.

13. Apparatus according to claim 1 in which the means to depress the insertion tips and the respective first edges of the respective slots comprise insertion pins which are moveable in a downward direction to press against the insertion tips to depress them and retain them in depressed position for advance of the insertion tips and non-return edges through the slots, the insertion pins being retractable to bring them clear of the first and second margins.

14. Apparatus as claimed in claim 13 in which the means to advance the insertion tips and the non-return edges through the slots comprises the clamping members extending from the wall of the second rectangular block.

* * * * *